United States Patent [19]

Ulin

[11] 4,304,517

[45] Dec. 8, 1981

[54] CHAFF EJECTION DEVICE

[75] Inventor: Carl-Otto Ulin, Järfälla, Sweden

[73] Assignee: U.S. Philips Corporation, New York, N.Y.

[21] Appl. No.: 120,969

[22] Filed: Feb. 13, 1980

[30] Foreign Application Priority Data

Mar. 2, 1979 [SE] Sweden ..... 7901890

[51] Int. Cl.[3] ..... F42B 13/42

[52] U.S. Cl. ..... 414/412; 83/437; 83/909; 244/136; 343/18 E

[58] Field of Search ..... 414/412; 244/136, 137 R; 89/1 R, 1.5 R; 343/18 E; 83/437, 431, 909; 102/89 CD

[56] References Cited

U.S. PATENT DOCUMENTS

| | | | |
|---|---|---|---|
| 2,954,948 | 10/1960 | Johnson | 244/136 |
| 3,027,047 | 3/1962 | Johnson | 102/89 CD X |
| 3,095,814 | 7/1963 | Jansen | 244/136 |
| 3,143,965 | 8/1964 | La Pointe | 102/89 CD X |
| 3,386,320 | 6/1968 | Pinkham et al. | 414/412 |
| 3,430,533 | 3/1969 | Kifor et al. | 244/136 X |
| 3,519,221 | 7/1970 | Kifor | 102/89 CD X |

OTHER PUBLICATIONS

WO 79/00658, Landström, 9/1979.

*Primary Examiner*—Trygve M. Blix
*Assistant Examiner*—Terrance L. Siemens
*Attorney, Agent, or Firm*—Thomas A. Briody; David R. Treacy; Robert J. Kraus

[57] ABSTRACT

A device for ejecting radar chaff comprising a magazine having a number of tubular cells in which chaff bundles are displaced towards an ejection end of the cell. The displacement of the chaff bundles is obtained by means of a plunger device which is longitudinally movable in each cell. Each plunger device is driven by a wire running from an attachment point on the plunger device to the ejection end, and therefrom to a driving wheel. The wire also drives a knife element. The knife edge of the knife element performs a cutting movement substantially longitudinally of the cell, the cutting movement preferably being rotational and in the opposite direction to the direction of movement of the chaff bundle.

5 Claims, 2 Drawing Figures

CHAFF EJECTION DEVICE

BACKGROUND OF THE INVENTION

The invention is directed to a device for ejecting radar chaff comprising an elongate magazine having a number of longitudinal tubular cells in each of which a bundle of chaff may be displaced by displacement means in the direction of an ejection end of said magazine at which end means are provided for detaching said chaff from said bundles by opening a cover surrounding the bundle.

In this specification the expression chaff will be used as a designation of radar interference means and should be considered to include the usual metal foil strips as well as corresponding means, e.g. metal covered glass fibres.

Devices of the type mentioned above are known and used for spreading so-called chaff clouds from airplanes, and the device is usually mounted below an airplane wing. A chaff cloud of this type will normally comprise a very great number of strips of different lengths forming electrical dipoles of corresponding lengths. The chaff causes interference in frequency bands which are dependent on the length of the dipoles and which are used for radar reconnaissance, homing missiles and similar uses.

SUMMARY OF THE INVENTION

An object of the invention is to provide a device of the type mentioned above which facilitates the ripping open of the chaff bundles and allows for displacement of the bundles by simple means which has a low weight and a low manufacturing cost.

According to the invention, a device of the type mentioned in the introduction is characterized in that said displacement means comprises, for each cell, a plunger device movable longitudinally in the cell and a wire connected to the plunger device and running therefrom in a loop towards said ejection end and back to driving means for driving said wire, and in that said means for detaching the chaff comprises a knife element having a knife edge adapted to extend into the moving chaff bundle at said ejection end and to perform a cutting movement substantially longitudinally of the cell.

In an embodiment of the invention, said wire runs over a pulley at said ejection end, and the pulley is connected with said knife element. The knife element edge extends into the cell through a slot provided in the cell wall at the ejection end. Cutting movement of the knife element is caused by rotation of the pulley at said ejection end. In this embodiment the knife element comprises a circular knife having its cutting edge situated substantially in a plane passing through the longitudinal axis of the cell.

The cutting movement of the knife at the point where it extends into the bundle may be directed in the opposite direction to the direction of movement of said chaff bundles. This can be achieved by running said wire within the cell between said plunger device and a reversing wheel, passing said wire out of the cell through an opening in the cell wall and conducting it over the pulley connected to the knife element and back over the reversing wheel to the driving means.

BRIEF DESCRIPTION OF THE DRAWING

An embodiment of the invention will now be described in detail, by way of example, with reference to the accompanying drawing, in which.

DESCRIPTION OF THE PREFERRED EMBODIMENT

Figure 1:
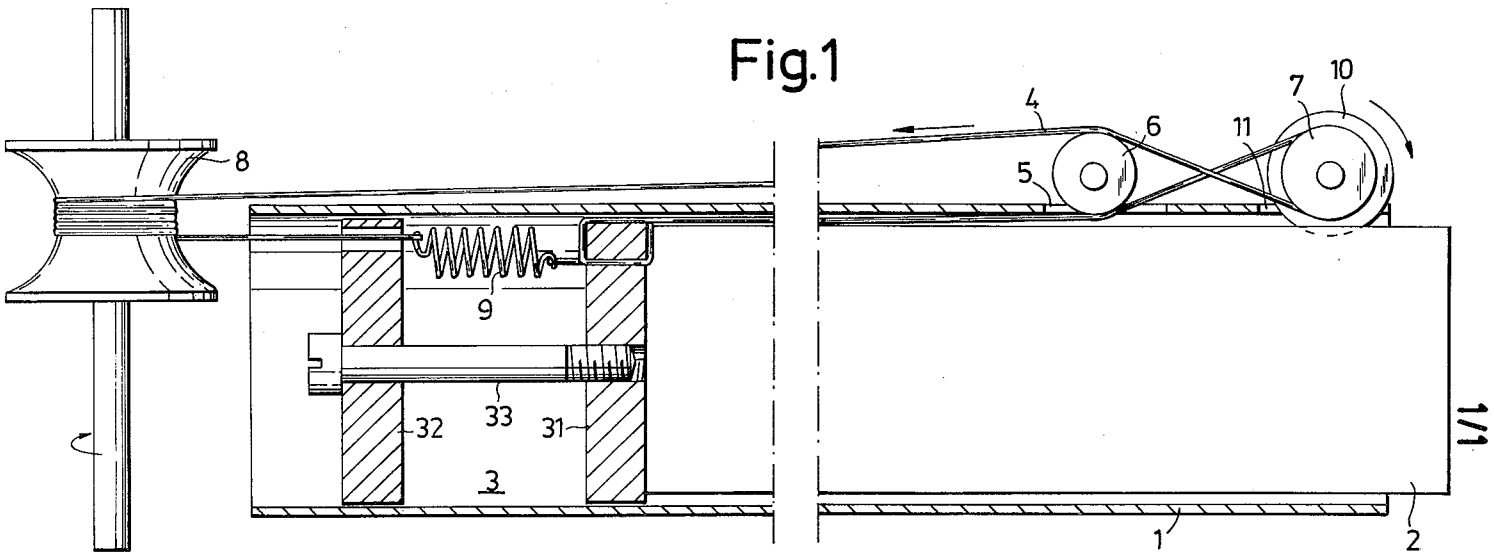
FIG. 1 is a schematic, partly sectional side view of a tubular cell an its associated displacement means and means for detaching the chaff.

The cell shown in FIG. 1 comprises a circular tubular cell 1, which is filled with chaff bundles 2. Said chaff bundles may be displaced in the direction of the ejection end of the cell by means of a plunger device 3. Said plunger device comprises two circular plates 31, 32 interconnected by means of a central part 33. This structure has been selected in order to provide a plunger device of low weight and of sufficient length in the longitudinal direction of the cell to prevent tilting of the plunger during displacement by a wire 4, one end of which is directly attached to the plate 31. From the plunger, said wire 4 runs within the cell in the direction of the ejection end. Near the ejection end the wire passes out through an opening 5 in the wall of the cell and over a reversing wheel 6. From said reversing wheel the wire runs to a pulley 7 arranged in a slot 11 at the ejection end. From said pulley 7 the wire runs via said reversing wheel back to a driving wheel 8, around which it is wound several times, at the other end of the cell, and from there into the cell again where the other end of the wire is attached to the plunger device via a coil spring 9. The coil spring maintains the wire in tension.

The driving wheel 8 may be rotated by means of a electric motor (not shown) in the direction indicated by an arrow. The knife element in this embodiment comprises a circular knife 10 which is combined with said pulley 7. The knife edge of the knife 10 extends into the cell a distance such that it will cut through the cover which surrounds said chaff bundles. By means of the reversing wheel 6 the knife 10 is made to rotate against the direction of movement of the plunger device and of the chaff bundles at the point of contact therewith and thus a good cutting action is secured.

In an alternative embodiment the reversing wheel 6 is eliminated and the wire 4 passes around the pulley 7 in such a manner that the knife edge rotates in the direction of movement of the chaff bundles. In order to obtain a good cutting action in this case the peripheral speed of the knife edge should be greater than the displacement speed of the chaff bundles at the point of conduct . This can be obtained by choosing a suitable diameter for the pulley.

As shown in FIG. 1, the wire is made to run within the cell. Normally the space between the cell and the chaff bundles will allow this because the chaff bundles usually have a relatively "soft" character and their shapes adapt to make room for the wire. However, it is possible, as an alternative, to have the wire run completely outside the cell and to provide on the plunger device a pin or similar means protruding through a longitudinal slot in the tube wall forming the cell. In such an embodiment the wire may be connected to said pin outside the tube wall.

Figure 2:
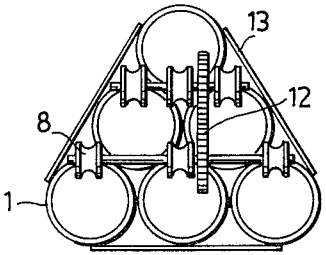
FIG. 2 is a schematic end view of a unit comprising a number of cells as shown in FIG. 1.

FIG. 2 is a schematic end view of a unit embodying the invention and comprising six of the cells 1 shown in FIG. 1. Preferably the cells 1 are connected together by welded joints and by wall elements 13. The driving wheels 8 of the respective cells are arranged on two parallel shafts each carrying three driving wheels 8. Said shafts are interconnected by means of gear-wheels 12. By this arrangement of the unit a common driving motor may be used for driving all of the plunger devices (see 3 in FIG. 1). The driving motor is not shown but may preferably be arranged to drive anyone of said gear wheels 12.

The magazine of an ejection device embodying the invention may comprise one or several units such as the one shown in FIG. 2. In the latter case such as magazine may e.g. comprise six of the units arranged with engaging wall elements 13 in order to obtain a magazine having a substantially cylindrical shape. In a magazine of this type the driving motors of the respective units may be selectively operable.

What is claimed is:

1. A device for ejecting radar chaff comprising an elongate magazine having a number of longitudinal, tubular cells in each of which a bundle of chaff may be displaced by displacement means in the direction of an ejection end of the magazine at which end means are provided for detaching the chaff from said bundle by opening a cover surrounding the bundle, characterized in that said displacement means comprises for each cell a plunger device movable longitudinally in the cell and a wire connected to the plunger device and running therefrom in a loop towards the ejection end and back to a driving means for driving said wire, and in that said means for detaching the chaff comprises a knife element having a knife edge adapted to extend into the moving chaff bundle at said ejection end and to perform a cutting movement directed substantially longitudinally of the cell.

2. A device as in claim 1, characterized in that said wire runs over a pulley at said ejection end, and in that the pulley is connected to said knife element, the knife edge of which extends into the cell through a slot provided in the cell wall at the ejection end, said cutting movement being caused by the rotation of the pulley.

3. A device as in claim 2, characterized in that said knife element comprises a circular knife combined with said pulley, the knife edge being situated substantially in a plane passing through the longitudinal axis of the cell.

4. A device as in claim 1, 2, or 3, characterized in that the cutting movement of the knife at the point where it extends into the bundle is in the opposite direction to the direction of movement of said chaff bundles.

5. A device as in claim 4, characterized in that said wire runs within the cell between said plunger device and a reversing wheel, passes out of the cell through an opening in the cell wall, and is conducted over the pulley connected to the knife element and back over the reversing wheel to the driving means.

* * * * *